US011192737B2

(12) United States Patent
Piening et al.

(10) Patent No.: US 11,192,737 B2
(45) Date of Patent: Dec. 7, 2021

(54) ADJUSTABLE COMPLIANCE OF SEPARATION STRIPS IN A MEDIA DAM

(71) Applicant: Lexmark International, Inc., Lexington, KY (US)

(72) Inventors: Chad Michael Piening, Lexington, KY (US); Todd Allison Quinn, Carlisle, KY (US); Curtis Duane Woodson, Georgetown, KY (US); Clark Edwin Jarnagin, Richmond, KY (US); Donald Eugene Proffitt, Richmond, KY (US); Louann Behymer Samuels, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 131 days.

(21) Appl. No.: 16/444,802

(22) Filed: Jun. 18, 2019

(65) Prior Publication Data

US 2020/0399082 A1 Dec. 24, 2020

(51) Int. Cl.
*B65H 3/52* (2006.01)
*B65H 3/56* (2006.01)

(52) U.S. Cl.
CPC ..... *B65H 3/5223* (2013.01); *B65H 3/56* (2013.01); *B65H 2301/12* (2013.01); *B65H 2301/152* (2013.01); *B65H 2301/422* (2013.01); *B65H 2301/42324* (2013.01); *B65H 2301/4423* (2013.01); *B65H 2404/56* (2013.01); *B65H 2405/1136* (2013.01)

(58) Field of Classification Search
CPC ..... B65H 3/56; B65H 3/5223; B65H 2405/1136; B65H 2301/4423; B65H 2301/152; B65H 2301/12
See application file for complete search history.

(56) References Cited

U.S. PATENT DOCUMENTS

| | | | | |
|---|---|---|---|---|
| 5,895,040 | A * | 4/1999 | Oleksa | B65H 3/5223 271/124 |
| 6,880,821 | B2 * | 4/2005 | Park | B65H 1/04 271/109 |
| 8,083,222 | B2 * | 12/2011 | Nakano | B65H 9/06 271/121 |
| 8,807,556 | B2 * | 8/2014 | Sugiyama | B65H 3/66 271/124 |
| 2014/0151954 | A1 * | 6/2014 | Furusawa | B65H 7/00 271/160 |

* cited by examiner

*Primary Examiner* — Jeremy R Severson

(57) ABSTRACT

In a copier, printer, or similar device, paper is loaded in large quantities. To separate a top sheet of a stack of sheets from the next adjacent sheet, a dam is used, which is an element having an inclined surface in the path of the top sheet. This invention addresses devices with variably compliant separation strips, preferably a thermoplastic polyurethane elastomer such as Pellethane®, that are part of the dam, so that the leading edge of a media sheet will strike the inclined surface of the separation strip. By adjusting the compliance of the separation strip, different weights of media may be accommodated while minimizing the multi-feeds that may cause jamming of the device.

2 Claims, 6 Drawing Sheets

ADJUSTABLE COMPLIANCE OF SEPARATION STRIPS IN A MEDIA DAM

CROSS REFERENCES TO RELATION APPLICATIONS

None.

FIELD OF THE INVENTION

This invention relates to the compliance of separation strips in a media dam for separating adjacent sheets of media being fed from a stack of sheets so that only one sheet is fed to a process station. More specifically, the compliance of the separation strips is adjustable depending on, for example, the media weight.

BACKGROUND OF THE INVENTION

One problem in feeding media from a stack of sheets of media is that the sheets may stick together and at least the next adjacent sheet may be fed at the same time. Accordingly, various separating means have been suggested for separating a top sheet of a stack of sheets of media from the next adjacent sheet when the feed is from the top of the stack of sheets of media.

It is known to separate a top sheet of a stack of sheets from the next adjacent sheet through using a dam, which is an element having an inclined surface in the path of the top sheet, as it is fed from the stack of sheets, so that its leading edge will strike the inclined surface of the dam.

The dam is inclined at an obtuse angle to the bottom surface of the tray and to the adjacent end of the stack of the sheets. The dam is a portion of a surface against which each of the sheets in the stack is advanced into engagement. The sheets are advanced towards a processing station (not shown) at which printing occurs.

Each of the sheets is advanced from the stack by a pick mechanism, or similar mechanism known to persons of ordinary skill in the art.

With reference to the Figures, the separation strips, are preferably a thermoplastic polyurethane elastomer such as Pellethane®. While the Pellethane® separation strips of the present invention have been shown and described as being used with a printer, it should be understood that the separation strips of the present invention may be used with any apparatus feeding a sheet from a media stack to a processing station, for example, in which only one sheet at a time is to be fed from the stack to the processing station.

In a printer, for example, the advancement of more than one sheet from the stack of sheets can cause jamming. Therefore, it is necessary to avoid simultaneously advancing more than one sheet from a stack of sheets of media to a processing station such as a printer.

SUMMARY OF THE INVENTION

This invention focuses on devices with variably compliant separation strips, preferably a thermoplastic polyurethane elastomer such as Pellethane®, that are part of the dam, so that the leading edge of a media sheet will strike the inclined surface of the Pellathane® strip. The terms "strips" and "separation strips" are intended to have the same meaning. References to "Pellethane® strips" or "Pellethane® separation strips" are intended to have the same meaning, and refer to strips composed of Pellethane®.

The compliant Pellethane® separation strips work well for separating most media, such as bond paper. There are, however, examples where the compliant Pellethane® strips are not ideal, such as for heavy card stock. There are at least two ways that paper weight is measured. The United States measures paper weight in pounds (for a given number of sheets), whereas it is standard to measure in grams per square meter outside of the United States. Persons of ordinary skill in the art understand that bond paper, also known as writing paper, is commonly used for printer paper or copier paper, and is characterized as weighing typically between about 16 and 36 pounds. Further, persons of ordinary skill in the art understand that heavier media, such as card stock, are thick and stiff, typically weighs between 60 to 120 pounds, and are frequently used for business cards, door hangers, menus, invitations, postcards, etc.

When heavier media, such as card stock, is used, the compliant Pellethane® strips allow more frequent multi-feeds. "Multi-feed" is the term used when two or more pages are picked during a single pick operation. Less-compliant or non-compliant Pellethane® strips on the dam prevents multi-feeds for heavier media.

In devices with compliant Pellethane® strips, each Pellethane® strips is spring loaded such that the spring compresses to allow the Pellathane® strip to flex in response to the leading edge of the media applying a force to the outermost surface during the pick operation. The page moves forward continuously due to the pick drive system, which moves the leading edge of the paper up the strip. As the leading edge translates up the strips, the load is removed and strips return to the original position.

The non-compliant (rigid) or less-compliant system prevents the media from building a bubble between the pick mechanism and the leading edge of the media while the media is in contact with the Pellethane® strip. Energy is increased at the leading edge of the media (i.e., less paper buckle). The increased energy allows multiple pages to separate from each other. The top page is then driven forward, while the pages below are retained by the leading edge bumping against the Pellethane® strip.

The compliant Pellethane® strips allow a bubble to build before enough force is developed to move the paper up the Pellethane® strip by allowing additional distance via Pellethane® movement due to spring compression, for example. That is, less energy at the paper leading edge and Pellethane® outermost surface interface.

The invention converts the compliant Pellethane® strip to a less-compliant or non-compliant (rigid) system. The invention may either vary the spring force, or completely remove the spring force all together. The system may be converted by simply adding an interference element, such as a wedge, on the back side of the Pellethane® strip housing to prevent the pellethane strips from moving when under load by the media.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
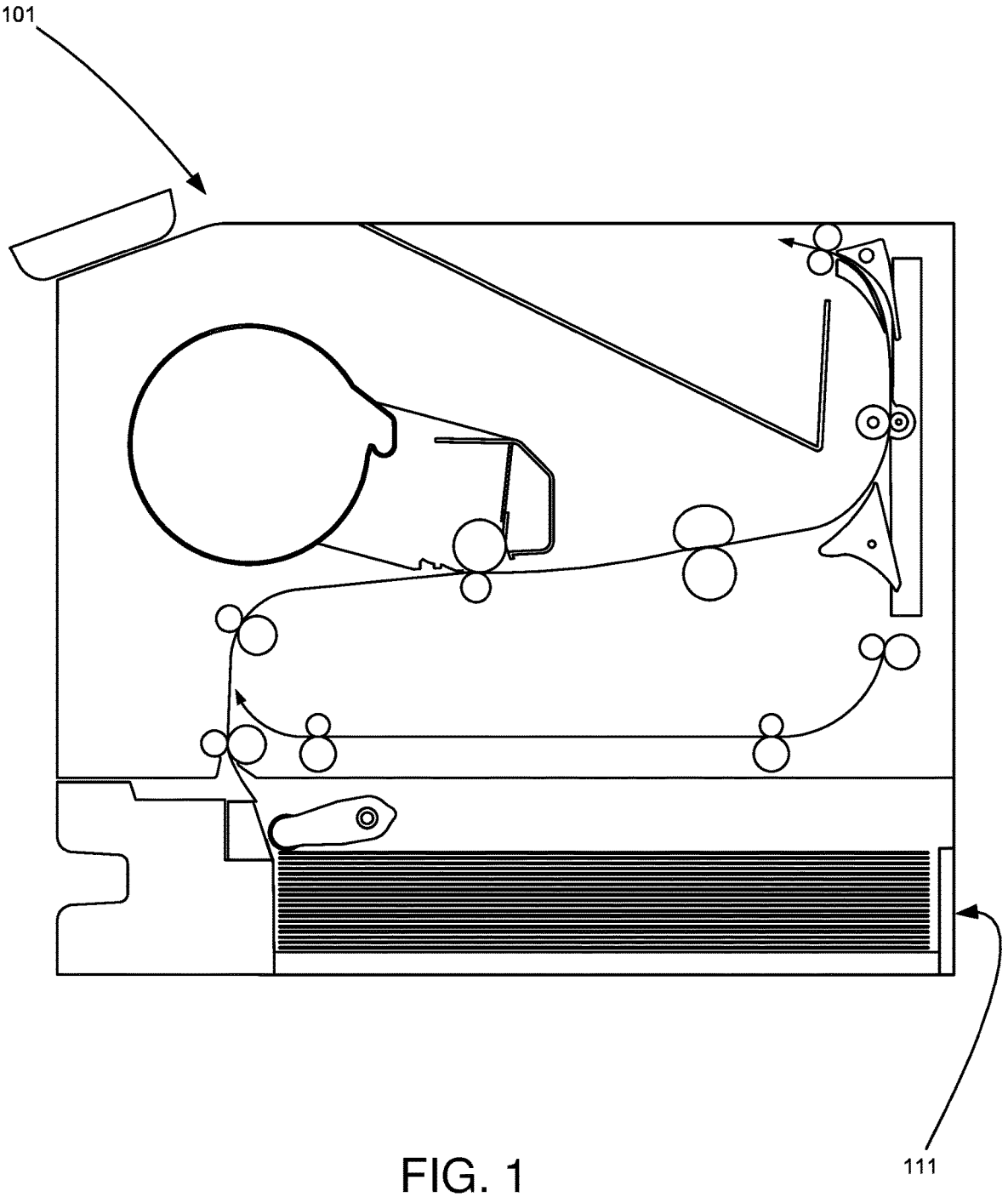
FIG. 1 is a side view of a printer.
Figure 2:
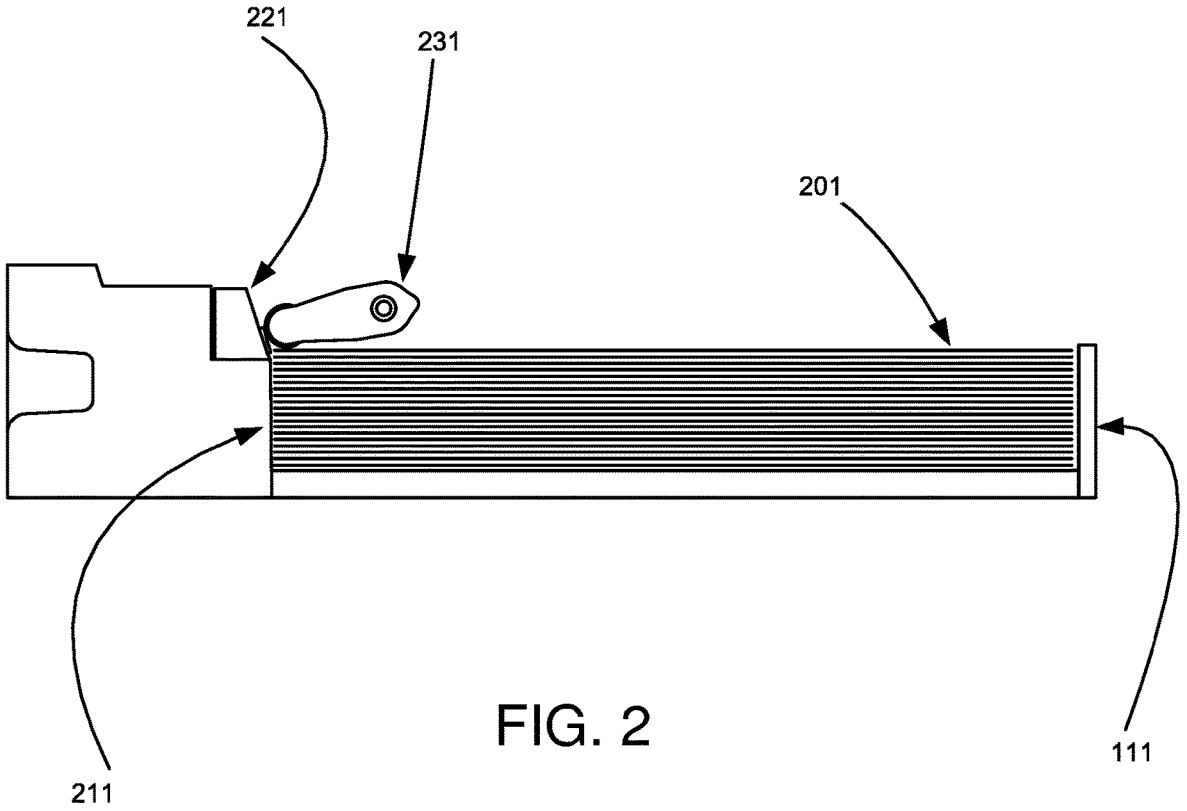
FIG. 2 is a side view of a printer tray having separation strips of the present invention with a stack of sheets of media therein and shown enlarged for clarity purposes.

Referring to the drawings, and particularly to FIGS. 1 and 2 thereof, there is shown a tray 111 used in a printer 101. The tray 111 supports a plurality of sheets 201 of a media such as bond paper, for example, in a stack. The sheets may be other media such as labels, envelopes, or card stock, for example. To separate a top sheet of a stack of sheets 201 from the next adjacent sheet through using a dam 211, which is an element having an inclined surface in the path of the top sheet, as it is fed from the stack of sheets 201, so that its leading edge will strike the inclined surface of the dam. In FIG. 2, the separator bracket assembly 221 with an inclined surface is shown as the top section of the dam 211.

Figure 3:
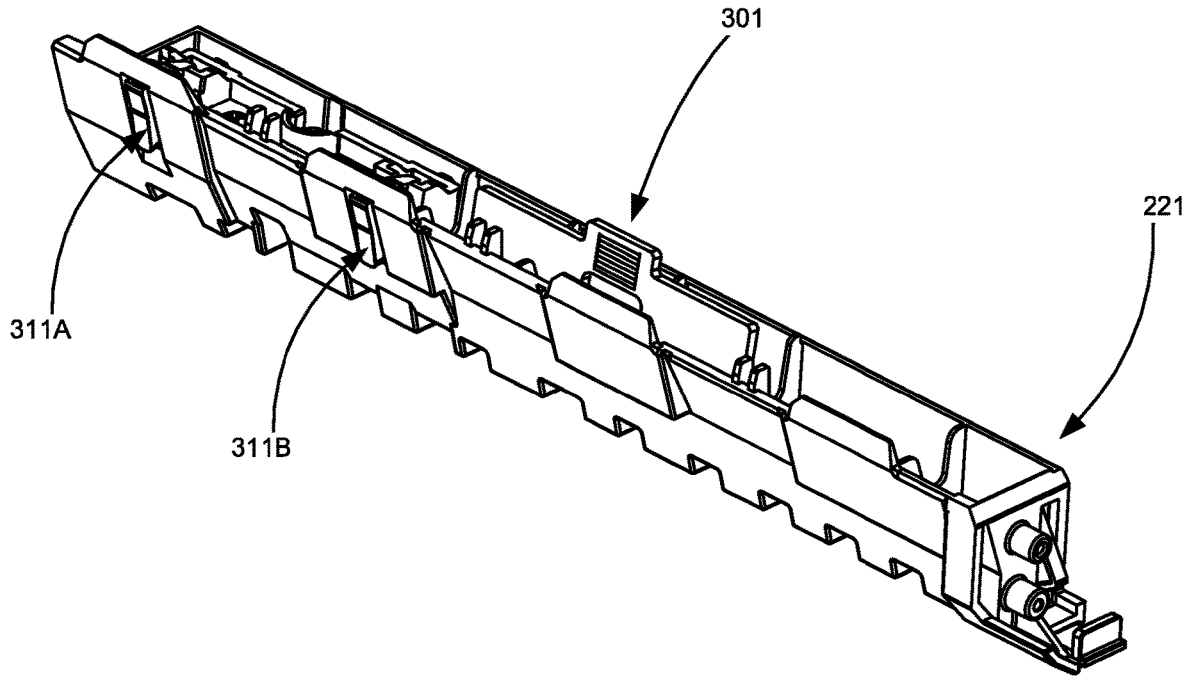
FIG. 3 is an inverted perspective view of the separator bracket assembly with a non-compliant blade element in a storage position.
Figure 4:
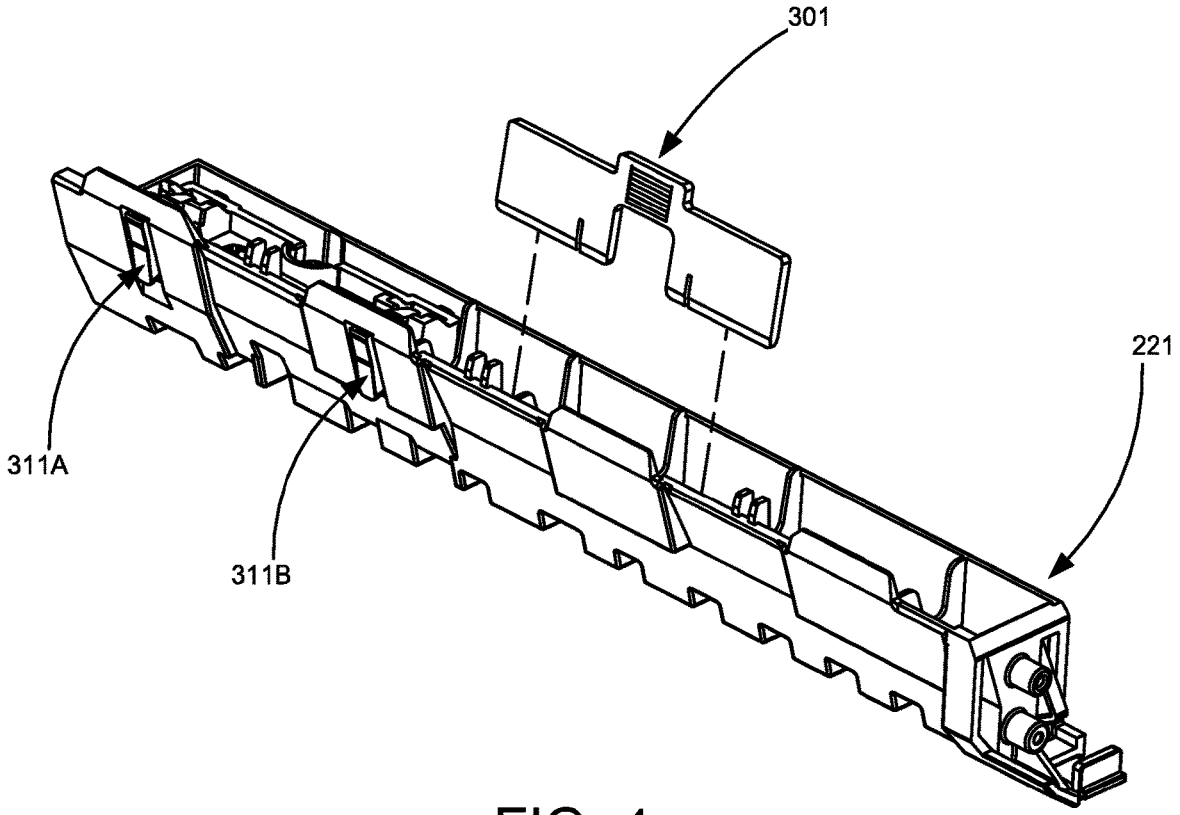
FIG. 4 is an inverted perspective view of the separator bracket assembly with a non-compliant blade element withdrawn from the storage position.
Figure 5:
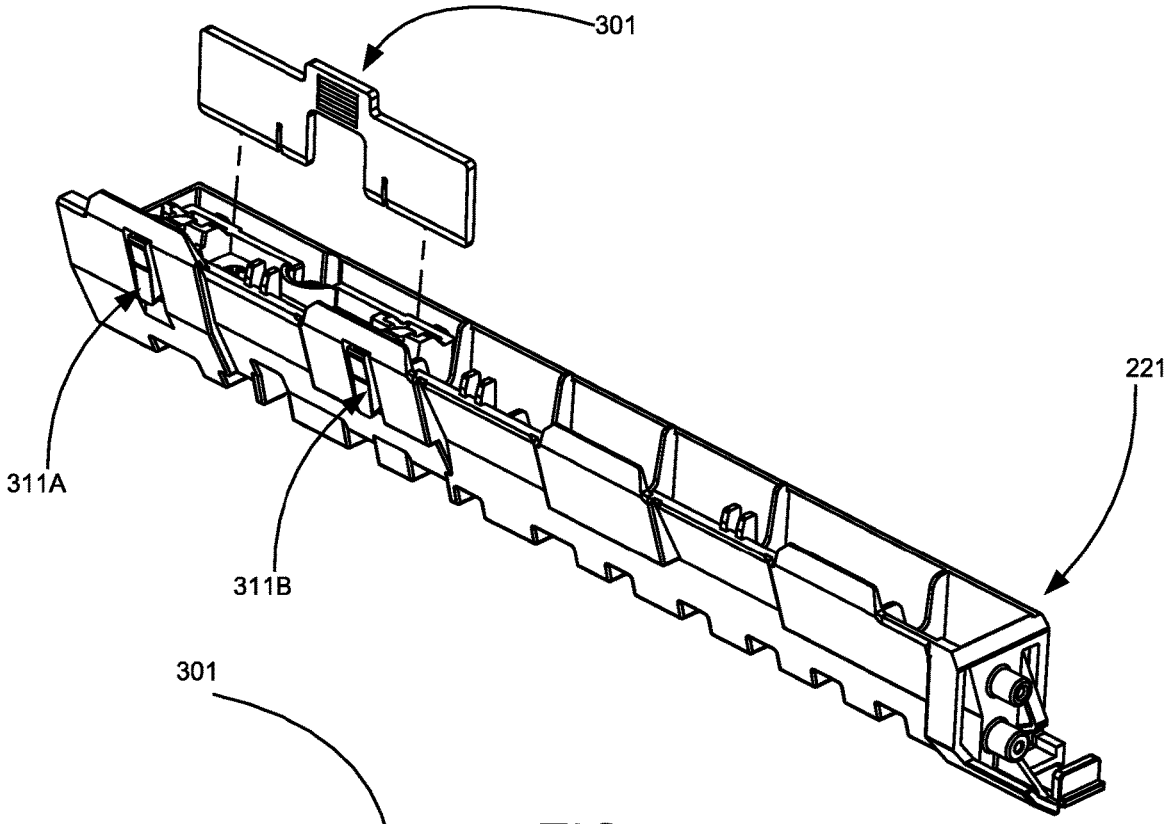
FIG. 5 is an inverted perspective view of the separator bracket assembly with a non-compliant blade element in position for insertion.
Figure 6:
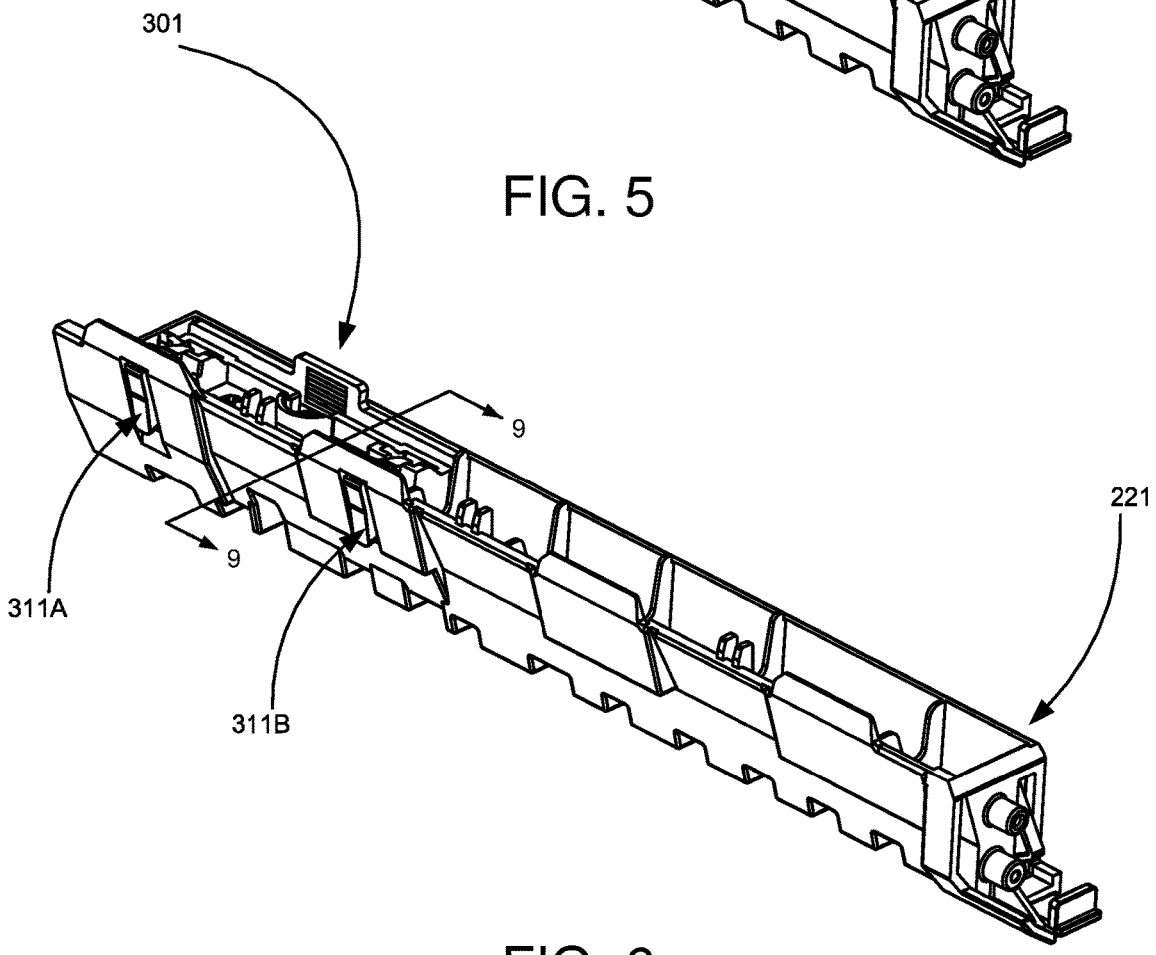
FIG. 6 is a view of the separator bracket assembly with a non-compliant blade element inserted.

In a first embodiment, a non-compliant blade 301, or other wedge element, is inserted, see FIGS. 5 and 6, to stop the compliance of the separator strips 311A, 311B in the assembly. The blade interferes with the compression movement of the spring 701A, 701B (shown in FIG. 7) that would allow the separator strips 311A, 311B to flex in response to the media load. When the separation strips are non-compliant, the pick performance of heavier media such as vinyl labels and card stock is improved when the pick-mechanism 231 roller grabs the paper to feed it into the printer such that fewer multi-feeds are observed. When feeding lighter media that is efficiently picked without multi-feeds, the wedge or blade element 301 can be housed inside of the dam element as shown in FIG. 3 without interfering with the separator strips. The blade element 301 is shown in the stored position in FIG. 3, withdrawn from the stored position in FIG. 4, positioned to insert in the non-compliance position in FIG. 5, and inserted in the non-compliance position in FIG. 6.

In a second embodiment, the user may operate a wheel-type cam system, or other device, to move a wedge element into position to lessen or eliminate the compliance of the separator strip elements. Pre-set positions may be selected depending on the particular weight of the media in use.

Figure 9:
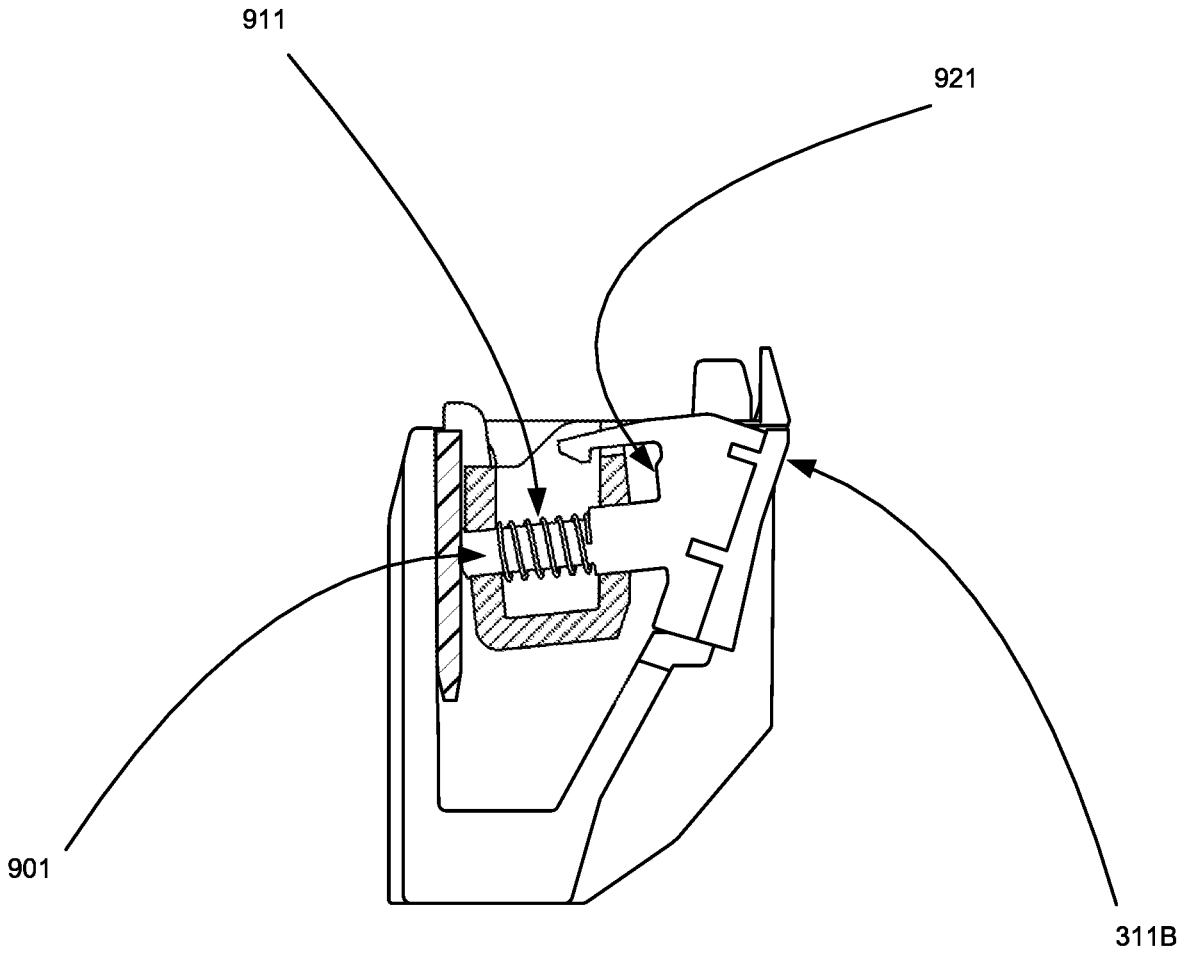
FIG. 9 is detail view of the separator strip spring assembly.

In the previous embodiments, the compliance of the separator strips is controlled by limiting the travel distance of an element of the separator strip, e.g., 311B, shown in FIG. 9 such as a protruding piston 901 positioned within the spring element 911, where the blade element 301 limits the travel distance of the piston. Other elements of the separator strip assembly such as the backing element 921 of the separator strip may contact a surface to prevent further travel.

Figure 7:
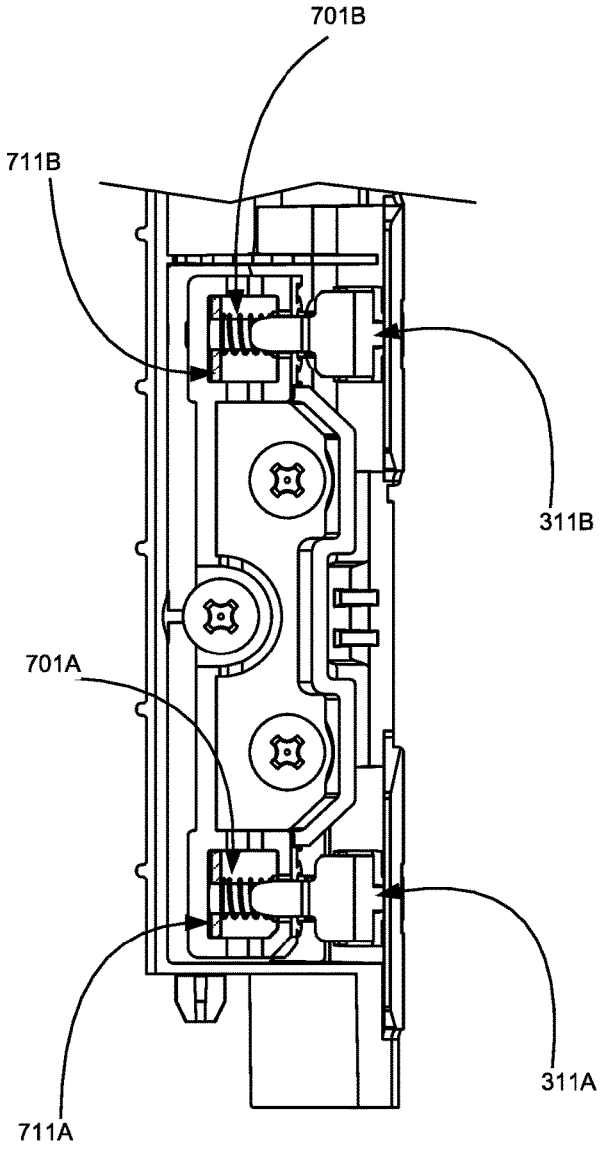
FIG. 7 is a top view of the assembly with the unimpeded spring element.
Figure 8:
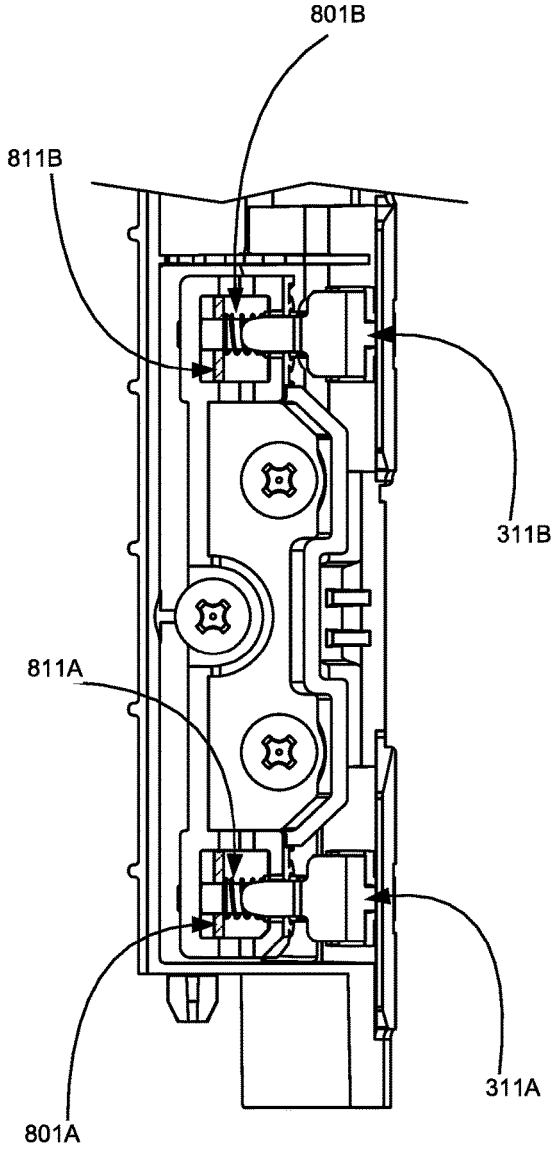
FIG. 8 is a top view of the assembly with a bearing plate adjusted to impede the compression travel distance of the spring element.

In a third embodiment shown in FIGS. 7 and 8, the compression travel distance of the spring 701A, 701B, and thus the force in the spring, is adjusted to control the compliance of the separator strips. A plate 711A, 711B, or other element, that serves as the back bearing surface of the spring element may be adjusted. In FIG. 7, the plate 711A, and 711B is shown in the extended position allowing a full range of compression of the spring 701A, 701B. In FIG. 8, the plate 811A, and 811B is shown in an adjusted second position that limits the range of compression of the spring 801A, 801B. The adjustment may be implemented manually by the user, or automatically by the system in response to the media characteristics, using either set points or continuously variable positions. The media characteristics may be input by the user, or measured by the system during operation.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. An apparatus for adjusting the compliance of separation strips in a dam of a printer media tray comprising:

a printer;

a media tray;

a dam adjacent the front end of the media tray;

at least one separation strip in the dam;

a non-compliant wedge element that interferes with compression movement of a spring that would allow the separation strip to flex in response to the media load, wherein the wedge element is a blade.

2. The apparatus according to claim 1, wherein the blade is housed inside of the dam element without interfering with the separator strips.

* * * * *